US009188404B2

(12) United States Patent
Camilleri

(10) Patent No.: US 9,188,404 B2
(45) Date of Patent: Nov. 17, 2015

(54) UNIFORM RECTILINEAR GUN

(71) Applicant: Steven Mark Camilleri, Limpertsberg (LU)

(72) Inventor: Steven Mark Camilleri, Limpertsberg (LU)

( * ) Notice: Subject to any disclaimer, the term of this patent is extended or adjusted under 35 U.S.C. 154(b) by 27 days.

(21) Appl. No.: 14/104,033

(22) Filed: Dec. 12, 2013

(65) Prior Publication Data

US 2014/0352192 A1 Dec. 4, 2014

Related U.S. Application Data

(60) Provisional application No. 61/829,275, filed on May 31, 2013.

(51) Int. Cl.
*F41A 21/18* (2006.01)
*F41A 21/16* (2006.01)
*F41A 21/32* (2006.01)

(52) U.S. Cl.
CPC ..... *F41A 21/32* (2013.01)

(58) Field of Classification Search
CPC ..... F41A 21/16; F41A 21/18; F41A 21/00; F41A 21/04; F41A 21/10; F41A 21/32; F41A 21/325
USPC ..... 42/76.01, 77, 78; 124/81
See application file for complete search history.

(56) References Cited

U.S. PATENT DOCUMENTS 252,241 A * 1/1882 Morris ..... 42/77
1,302,720 A * 5/1919 Schultz ..... 102/517
3,802,108 A * 4/1974 Mainhardt et al. ..... 42/77
5,735,256 A * 4/1998 Monk ..... 124/65
5,823,173 A * 10/1998 Slonaker et al. ..... 124/56
6,805,111 B2 * 10/2004 Tippmann, Jr. ..... 124/74
7,603,998 B2 * 10/2009 Finstad ..... 124/81
8,714,146 B2 * 5/2014 Hu ..... 124/84
2006/0101697 A1 * 5/2006 Bushnell ..... F41A 21/16 42/76.01
2007/0017498 A1 * 1/2007 Finstad ..... F41B 11/00 124/84
2007/0125351 A1 * 6/2007 Campo ..... F41A 21/32 124/56
2014/0150319 A1 * 6/2014 Mirabile ..... F41A 21/16 42/78
2014/0237879 A1 * 8/2014 Mirabile ..... F42B 5/025 42/78

* cited by examiner

*Primary Examiner* — Bret Hayes
*Assistant Examiner* — Derrick Morgan
(74) *Attorney, Agent, or Firm* — Withers & Keys, LLC

(57) ABSTRACT

This invention is a precision weapon that utilizes solely as a projectile, a precision-ball made out of a suitable material namely solid C260 brass. It employs a smoothbore precision-barrel with a metal toothed rack/rail affixed along the northern hemisphere of the muzzle of the barrel that effectively converts some of the forward motion of the ball into rotational motion so that the ball is mechanically forced to rotate upwards/backwards at very high speed that can run into millions of rotations per minute, vastly improving its ballistic coefficient and downrange accuracy. The weapon can be produced in a variety of existing types of firearms such as bolt-action, falling-block or semi-automatic, and can be chambered for a variety of calibers. A 5.5625 mm caliber bolt-action rim fire weapon for instance will provide a user with a weapon ideal for hunting small-game or for target shooting purposes. See FIGS. 1, 2 and 3.

15 Claims, 3 Drawing Sheets

UNIFORM RECTILINEAR GUN

CROSS-REFERENCE TO RELATED APPLICATIONS

This patent application claims the benefit of priority to U.S. Provisional Patent Application Ser. No. 61/829,275 filed on May 31, 2013 and entitled "The Uniform Rectilinear Gun (URG)", the subject matter of which is hereby incorporated by reference in its entirety.

FIELD OF THE INVENTION

The present invention is directed to projectile-discarding weapons (e.g., small-arms, firearms, and air guns) and ammunition for use in the disclosed weapons.

BACKGROUND OF THE INVENTION

The quest for a projectile-discharging weapon with an even flatter trajectory is ongoing and relentless. Most projectiles employed in the industry are usually pointed for a better ballistic coefficient and yet are expected to dissipate as much kinetic energy as possible once they meet a target. This entails distinct and complex forms that are usually expensive to produce. In addition, the only way to achieve very flat trajectories utilizing such projectiles seems to be via elevated muzzle velocities.

SUMMARY OF THE INVENTION

This invention is a precision weapon that utilizes solely as a projectile, a precision-ball made out of solid copper or C260 brass or other suitable material or a combination of these materials. A ball discharged from the weapon is mechanically forced to rotate upwards/backwards at very high speeds that can run into millions of rotations per minute, vastly improving it's ballistic coefficient and downrange accuracy. In addition, the ball's trajectory is expected to be almost flat for a distance that can be expressed as a proportion of it's muzzle velocity. This means that a user will not need to factor in projectile trajectory-drop for specific ranges. Wind drift should also be reduced when compared to other weapons that discharge pointed and elongated projectiles since gyroscopically spun projectiles of this type that spin clockwise or anticlockwise around their longitudinal axis, are more likely to drift to the left or the right as they travel towards an intended target. The precision-ball is a straightforward, economical and uniform projectile that, due to a very high rate of upward/backward spin, will remain true in flight, maintain a relatively flat trajectory even at relatively low velocities and can achieve ideal kinetic energy transfer once it impacts a target, without over penetrating. The backspinning nature of the ball combined with a very high rate of rotations per second means that the ball is unlikely to ricochet off a hard surface and is compelled to move downwards towards the ground upon impact, making it a safe alternative.

These and other features and advantages of the present invention will become apparent after a review of the following detailed description of the disclosed embodiments and the appended claims.

BRIEF DESCRIPTION OF THE FIGURES

The present invention is further described with reference to the appended figures showing exemplary embodiments of the present invention, wherein.

DETAILED DESCRIPTION OF THE INVENTION

Figure 1:
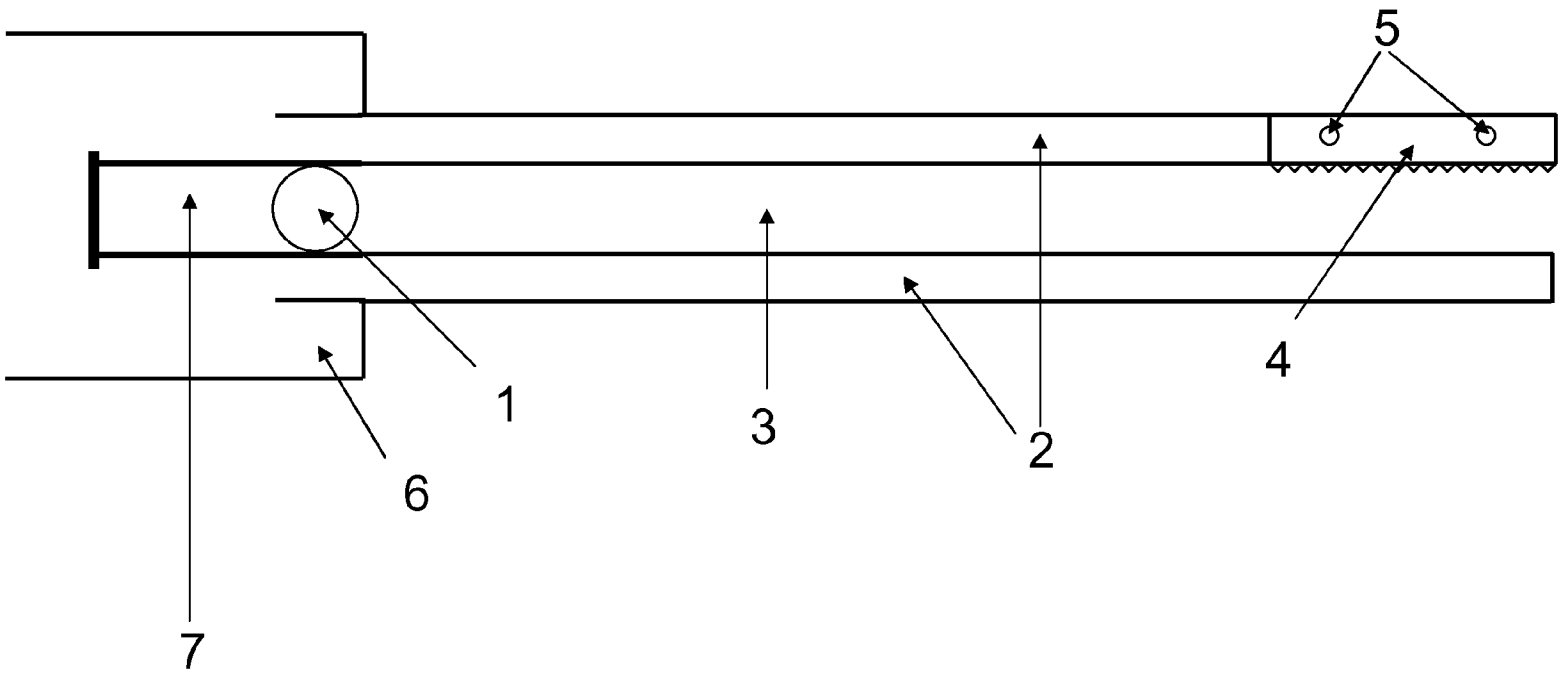
FIG. 1 depicts a general overview of an exemplary gun of the present invention.

A gun comprising a source of propulsion in the form of a rimfire or centrefire cartridge or a compressed-air source or other (7) and utilizing solely as a projectile, a precision-ball (1) made of a suitable material such as C260 brass, that also employs a stainless steel or other precision-barrel (2) with a tungsten carbide coated or other precision smoothbore (3), also employing a metal toothed rack/rail (4) of specific dimensions and perforated in specific places, that is slotted through along the northern hemisphere of the muzzle of the barrel and is non-permanently affixed via steel holding pins (5), so that only the teeth penetrate a portion of the northern hemisphere of the muzzle of the bore, a specific distance, and engage and indent (8) the northern leading edge/circumference of the ball as it progresses to exit the barrel of the gun, effectively transforming the leading edge/circumference of the virgin ball into a cogwheel. The length of the toothed rack/rail is equal to the caliber of the weapon multiplied by 3.14159, however any specifications or dimensions relating to the toothed rack/rail, it's positioning and the method of affixing it to the barrel are subject to change.

Alternatively, the toothed rack/rail can also be directly cut into the bore of the barrel as part of the barrel manufacturing process.

The virgin ball accelerates through the precision smoothbore barrel until it encounters the first of a series of triangular teeth of the rack/rail, penetrating the northern hemisphere of the muzzle of the bore and is mechanically forced to rotate upwards/backwards as each progressive tooth engages and indents it's northern leading edge. The ball leaves the barrel of the gun under the influence of the toothed rack/rail that presses it downwards against the southern hemisphere of the muzzle crown and locks it so that, when viewed from the front, it cannot rotate either clockwise or anticlockwise.

FIG. 1 provides a general overview of the gun. The following features are shown in FIG. 1:

precision-ball 1;

precision-barrel 2;

precision-barrel bore 3;

toothed rack/rail 4 made of tool steel or tungsten carbide coated stainless steel, slotted through the northern hemisphere of the barrel 2 so that only the teeth penetrate the bore 3 (Note, FIG. 1 provides a see-through image showing rack/rail 4 slotted through along the muzzle of the barrel 2.);

steel holding pins 5;

breech 6; and rimfire or centrefire cartridge or compressed-air source or other 7.

Figure 2:
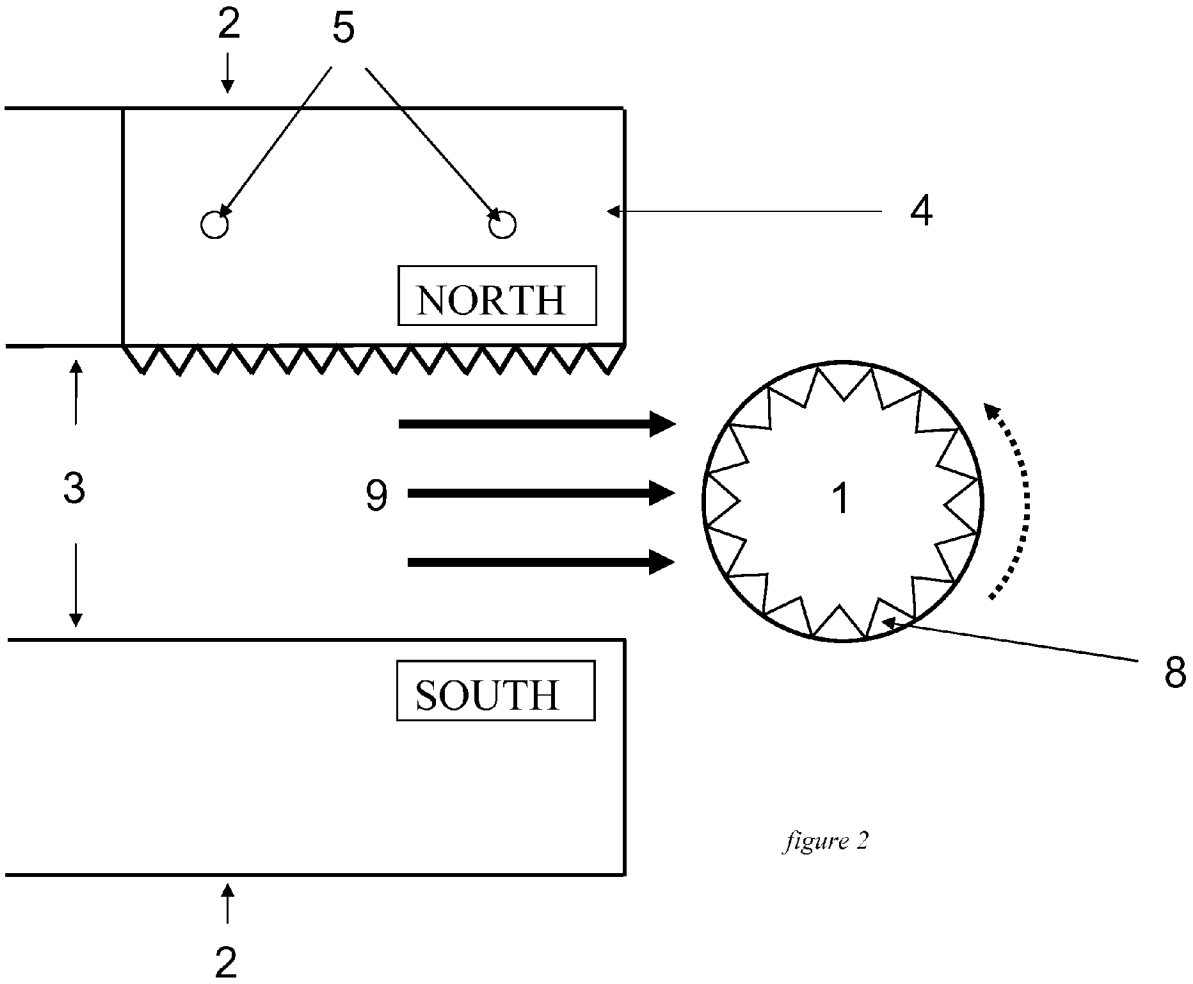
FIG. 2 depicts a close-up side profile of the muzzle portion of the exemplary gun shown in FIG. 1.

FIG. 2 depicts a side profile of the muzzle of the gun. The following features are shown in FIG. 2:

precision-ball 1 (Note, FIG. 2 provides a see-through image showing triangular indentations made by the teeth of the rack/rail 4 on the leading edge/circumference of the ball 1);

precision-barrel 2;

precision-barrel bore 3;

toothed rack/rail 4 made of tool steel or tungsten carbide coated stainless steel, slotted through the northern hemisphere of the barrel 2 so that only the teeth penetrate the bore 3 (As noted above, FIG. 2 provides a see-through image showing rack/rail 4 slotted through and along the muzzle of the barrel 2);

steel holding pins 5;

indentations 8 made on the ball 1 by the teeth of the rack/rail 4; and high-pressure air or hot gases 9.

Figure 3:
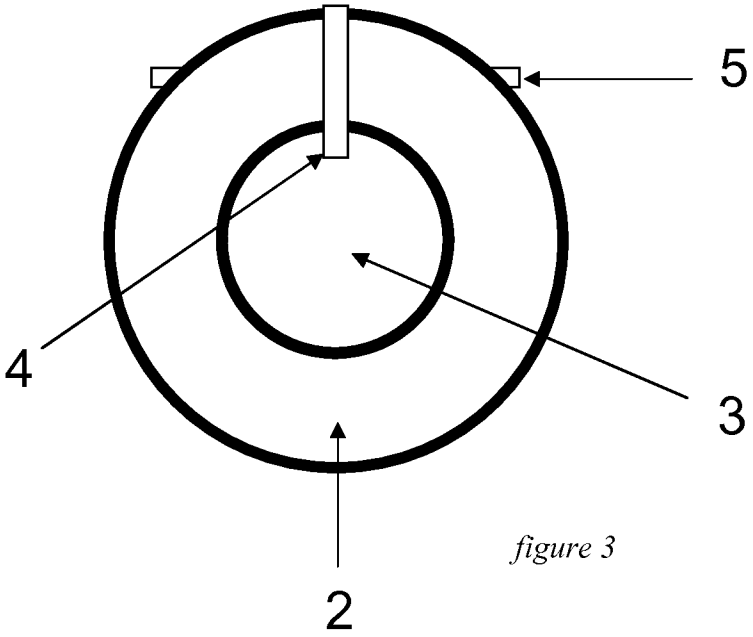
FIG. 3 depicts a frontal view of the exemplary gun shown in FIG. 1 as viewed down the barrel of the exemplary gun.

FIG. 3 depicts a front view of the muzzle of the gun. The following features are shown in FIG. 3:

precision-barrel 2;

precision-barrel bore 3;

toothed rack/rail 4 made of tool steel or tungsten carbide coated stainless steel, slotted through along the northern hemisphere of the barrel 2 so that only the teeth penetrate the bore 3; and steel holding pins 5 that transverse both the walls of the northern hemisphere of the barrel 2 and the toothed rack/rail 4, effectively securing the toothed rack/rail 4 to the muzzle of the barrel 2 in a non-permanent manner.

The present invention comprises a precision weapon that utilizes solely as a projectile, a precision-ball 1 made out of a suitable material, namely solid C260 brass. The precision weapon comprises a smoothbore precision-barrel 2 with a metal toothed rack/rail 4 affixed along the northern hemisphere of the muzzle of the barrel 2 that effectively converts some of the forward motion of the ball 1 into rotational motion so that the ball 1 is mechanically forced to rotate upwards/backwards at very high speed that can run into millions of rotations per minute, vastly improving its ballistic coefficient and downrange accuracy. The weapon can be produced in a variety of existing types of firearms such as bolt-action, falling-block or semi-automatic, and can be chambered for a variety of calibers. A 5.5625 mm caliber bolt-action rim fire weapon, for instance, will provide a user with a weapon ideal for hunting small-game or for target shooting purposes.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A projectile-firing weapon comprising:

a smoothbore precision barrel having a circular inner barrel cross-section and a muzzle at one barrel end;

a metal toothed rail positioned along an upper inner surface of the barrel, said rail extending (i) along a length of a bore of the barrel and (ii) into the bore of the barrel a specific distance so that the teeth of the rail engage with and indent a leading edge and circumference of a projectile traveling along the barrel so as to impart a specific rate of upward spin on the projectile as it the projectile exits the muzzle of the weapon; and wherein said smoothbore precision barrel further comprises (i) a slot extending through and along a sidewall of said barrel from an outer surface of said barrel to said bore, said slot being sized to accept at least a portion of said metal toothed rail therein, and (ii) one or more channels extending through said sidewall from a first location along said outer surface on one side of said slot through said slot to a second location along said outer surface on an opposite side of said slot.

2. A firearms ammunition cartridge comprising a projectile consisting of a grade 200 C260 brass ball, said projectile being sized so as to be firable from the weapon of claim 1.

3. The projectile-firing weapon of claim 1, wherein said one or more channels comprise two channels extending through said sidewall, each channel extending from a first location along said sidewall on one side of said slot through said slot to a second location along said sidewall on an opposite side of said slot.

4. The projectile-firing weapon of claim 3, wherein said metal toothed rail is positioned within and through said slot.

5. The projectile-firing weapon of claim 4, wherein said weapon further comprises one or more holding pins sized to extend through (i) each channel of said barrel and (ii) said metal toothed rail while said metal toothed rail is positioned within said slot.

6. The projectile-firing weapon of claim 1, wherein said metal toothed rail forms an integral portion of said upper inner surface of said barrel.

7. The projectile-firing weapon of claim 1, wherein said metal toothed rail has a rail length extending along said upper inner surface, said rail length being equal to (3.14159)×C, wherein C is a caliber of the weapon.

8. The projectile-firing weapon of claim 1, wherein said barrel comprises stainless steel, and said teeth comprise tool steel or tungsten carbide coated stainless steel.

9. A projectile-firing weapon comprising:

a smoothbore precision barrel having a circular inner barrel cross-section and a muzzle at one barrel end;

a slot extending through and along a length of a sidewall of said barrel from an upper outer surface of said barrel to an upper inner surface of a bore of said barrel;

a metal toothed rail positionable within said slot so as to extend into the bore of the barrel a specific distance so that teeth of the rail engage with and indent a leading edge and circumference of a projectile traveling along the barrel so as to impart a specific rate of upward spin on the projectile as the projectile exits the muzzle of the weapon;

wherein said smoothbore precision barrel further comprises two channels extending through said sidewall, each channel extending from a first location along said upper outer surface on one side of said slot to a second location along said upper outer surface on an opposite side of said slot; and wherein said weapon further comprises two holding pins sized to extend through (i) each channel and (ii) said metal toothed rail while said metal toothed rail is positioned within said slot.

10. The projectile-firing weapon of claim 9, wherein said metal toothed rail has a rail length extending along said upper inner surface, said rail length being equal to (3.14159)×C, wherein C is a caliber of the weapon.

11. The projectile-firing weapon of claim 9, wherein said barrel comprises stainless steel, and said teeth comprise tool steel or tungsten carbide coated stainless steel.

12. A firearms ammunition cartridge comprising:

a projectile comprising a metal ball sized to be firable from the weapon of claim 9, said metal ball comprising solid copper, C260 brass, or a combination thereof.

13. A firearms ammunition cartridge comprising:

a projectile comprising a metal ball sized to be firable from the weapon of claim 11, said metal ball comprising solid copper, C260 brass, or a combination thereof.

14. A firearms ammunition cartridge comprising:

a projectile comprising a metal ball sized to be firable from the weapon of claim 11, said metal ball comprising C260 brass.

15. A projectile-firing weapon and ammunition cartridge combination, said combination comprising:

a projectile-firing weapon comprising: a smoothbore precision barrel having a circular inner barrel cross-section and a muzzle at one barrel end;

a metal toothed rail positioned along an upper inner surface of the barrel, said rail extending (i) along a length of a bore of the barrel and (ii) into the bore of the barrel a specific distance so that teeth of the rail engage with and indent a leading edge and circumference of a projectile traveling along the barrel so as to impart a specific rate of upward spin on the projectile as the projectile exits the muzzle of the weapon;

a firearms ammunition cartridge comprising: a projectile comprising a metal ball sized to be firable from the weapon; and wherein said barrel comprises stainless steel; said teeth comprise tool steel or tungsten carbide coated stainless steel; and said metal ball comprises solid copper, C260 brass, or a combination thereof.

* * * * *